US011889905B2

(12) United States Patent
Chang et al.

(10) Patent No.: US 11,889,905 B2
(45) Date of Patent: Feb. 6, 2024

(54) WEARABLE DEVICE

(71) Applicant: HTC Corporation, Taoyuan (TW)

(72) Inventors: Li-Hsun Chang, Taoyuan (TW); Yu-Hsun Chung, Taoyuan (TW); Chen-Fu Chang, Taoyuan (TW)

(73) Assignee: HTC Corporation, Taoyuan (TW)

( * ) Notice: Subject to any disclaimer, the term of this patent is extended or adjusted under 35 U.S.C. 154(b) by 22 days.

(21) Appl. No.: 17/858,089

(22) Filed: Jul. 6, 2022

(65) Prior Publication Data

US 2024/0008602 A1 Jan. 11, 2024

(51) Int. Cl.

| | |
|---|---|
| ***A44C 5/14*** | (2006.01) |
| ***A44B 11/14*** | (2006.01) |
| ***A44C 5/20*** | (2006.01) |

(52) U.S. Cl.

CPC ..... *A44C 5/2042* (2013.01); *A44B 11/14* (2013.01); *A44C 5/14* (2013.01); *Y10T 24/4782* (2015.01)

(58) Field of Classification Search

CPC ..... A44B 11/14; A44C 5/2042; A44C 5/14; A44C 5/16; A44C 5/20; A44C 5/2071; A44C 5/145; Y10T 24/4074; Y10T 24/4782; Y10T 24/4755; A44D 2205/00

See application file for complete search history.

(56) References Cited

U.S. PATENT DOCUMENTS

| | | | | |
|---|---|---|---|---|
| 6,179,177 | B1 * | 1/2001 | Hihara | A44C 5/145 24/70 J |
| 2013/0223195 | A1 * | 8/2013 | Loetscher | A44C 5/2042 368/282 |
| 2016/0037841 | A1 * | 2/2016 | Dey | A44C 27/001 2/170 |
| 2020/0029661 | A1 | 1/2020 | Tobiassen et al. | |
| 2020/0337421 | A1 | 10/2020 | Barros | |
| 2022/0179451 | A1 | 6/2022 | Edwards | |

FOREIGN PATENT DOCUMENTS

| | | |
|---|---|---|
| CN | 212112157 | 12/2020 |
| TW | M622783 | 2/2022 |

OTHER PUBLICATIONS

English translation of TW M622783U as machine translated from Espacenet (Year: 2023).*

* cited by examiner

*Primary Examiner* — Robert Sandy
*Assistant Examiner* — Michael S Lee
(74) *Attorney, Agent, or Firm* — JCIPRNET

(57) ABSTRACT

A wearable device includes a main body and a coupling member. The main body has a tail portion and a hook portion at two opposite sides respectively. One end of the coupling member is connected to the tail portion. A buckle hole of another end of the coupling member is for sleeving onto the hook portion to fix the main body to a subject.

7 Claims, 8 Drawing Sheets

WEARABLE DEVICE

BACKGROUND OF THE INVENTION

Field of the Invention

The present application relates to a wearable device, and in particular, to a wearable device that is readily fixed to a subject.

Description of Related Art

When a user fixes the current common wearable device on the body, it is often necessary to use both hands at the same time to perform the operation, or the wearable device needs to be leaned on a desktop or other objects in order to readily complete the wearing action. For example, when the user wears a watch on the wrist, they need to lean the wrist on which the watch is worn against the object, and put on the watch with the other hand. However, for users who are unfamiliar with one-handed operation, it takes a lot of time to wear or remove the wearable device, causing inconvenience to the user. And if care is not taken, the wearable device readily falls on the ground and becomes damaged.

SUMMARY OF THE INVENTION

The present application provides a wearable device that may improve the convenience of a user when wearing or removing the wearable device.

A wearable device of the present application includes a main body and a coupling member. The main body has a tail portion and a hook portion at two opposite sides respectively. One end of the coupling member is connected to the tail portion. A buckle hole of another end of the coupling member is for sleeving onto the hook portion to fix the main body to a subject.

Based on the above, in the wearable device of the present application, the user may wear and remove the wearable device simply by inserting or separating the buckle hole from the hook portion. The method of wearing and removing the wearable device is simple, and the time needed for wearing and removing the wearable device is reduced.

DESCRIPTION OF THE EMBODIMENTS

Figure 1:
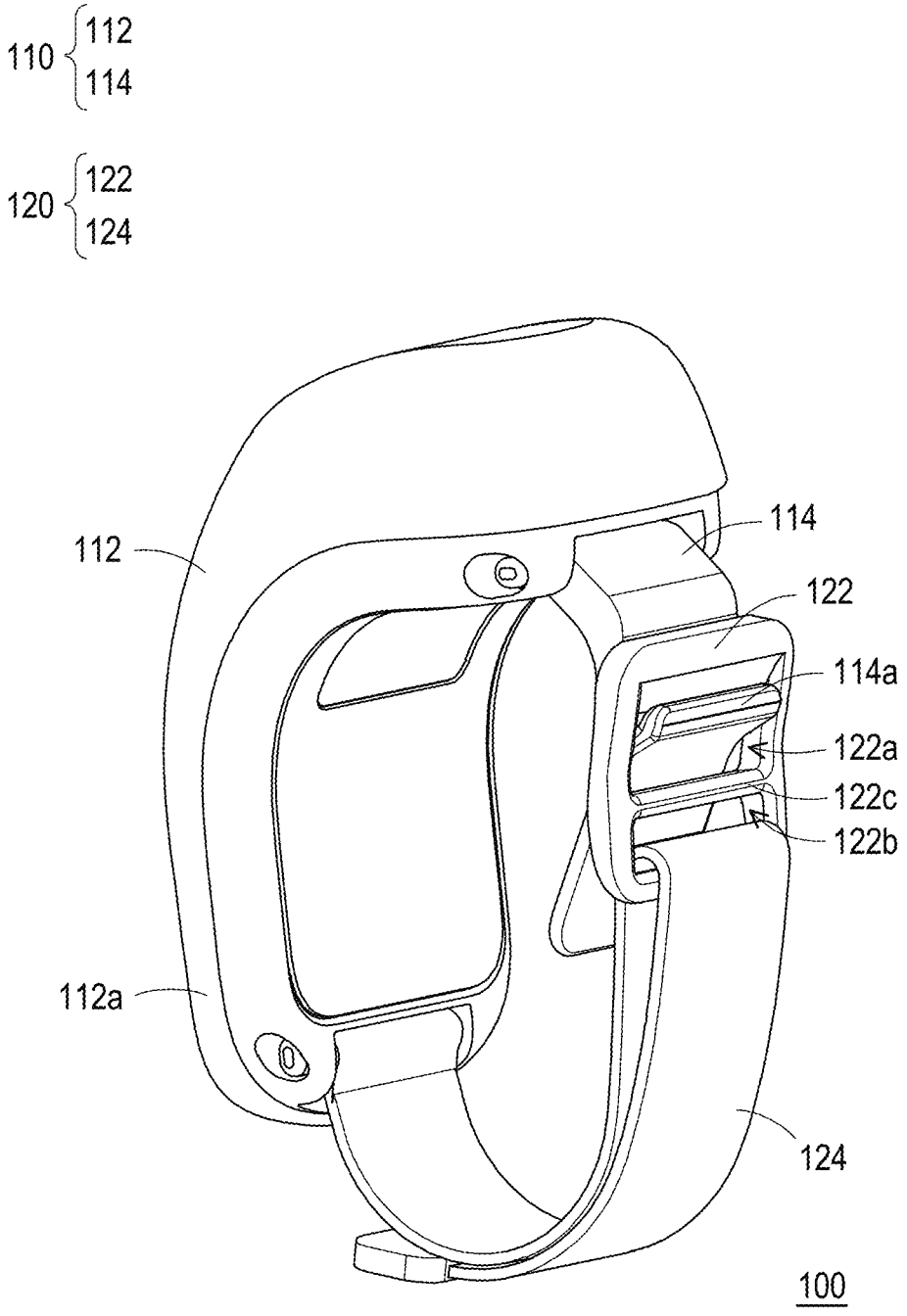
FIG. 1 is a schematic view of a wearable device according to an embodiment of the invention.
Figure 2:
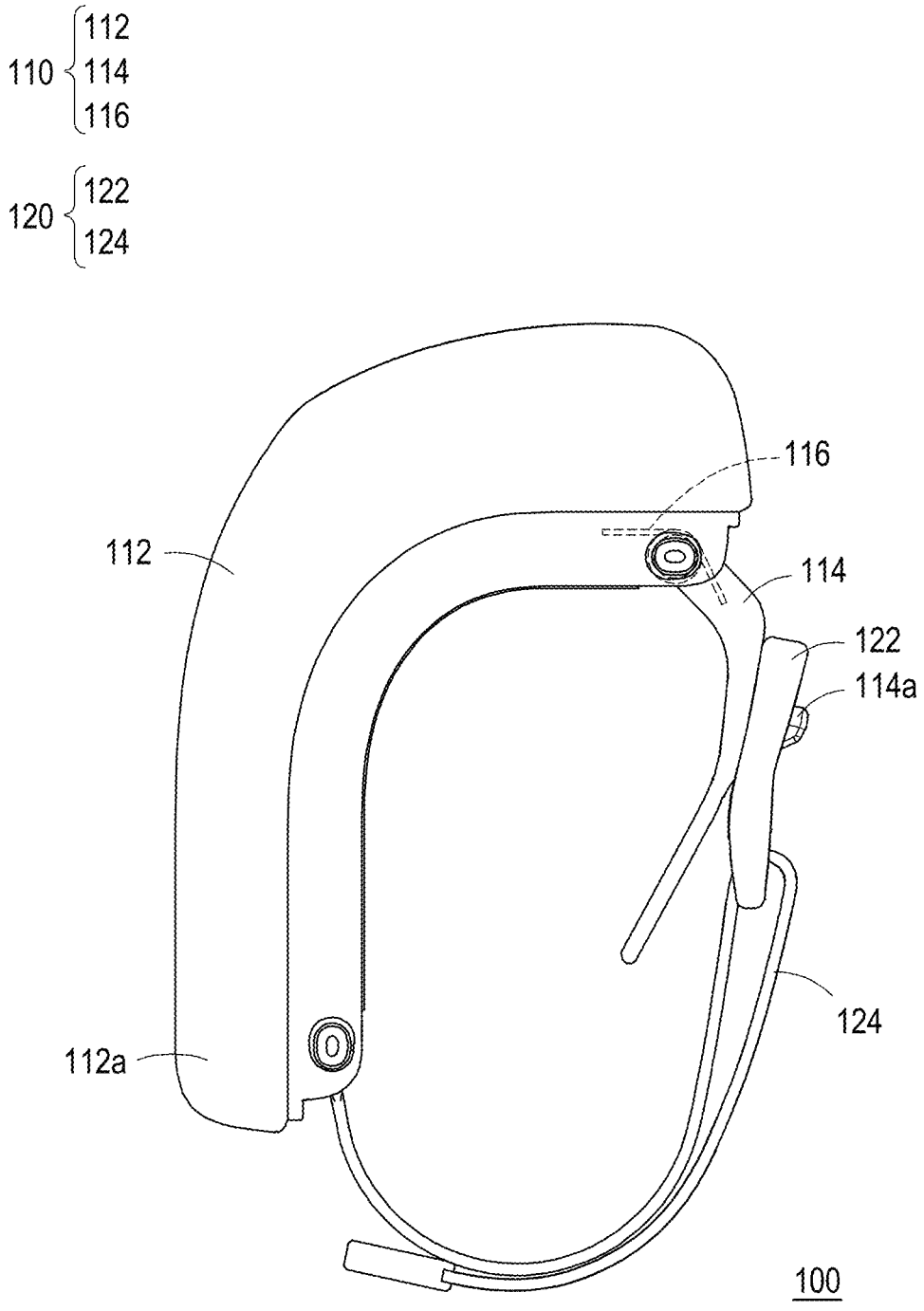
FIG. 2 is a schematic side view of the wearable device of FIG. 1.
Figure 3A:
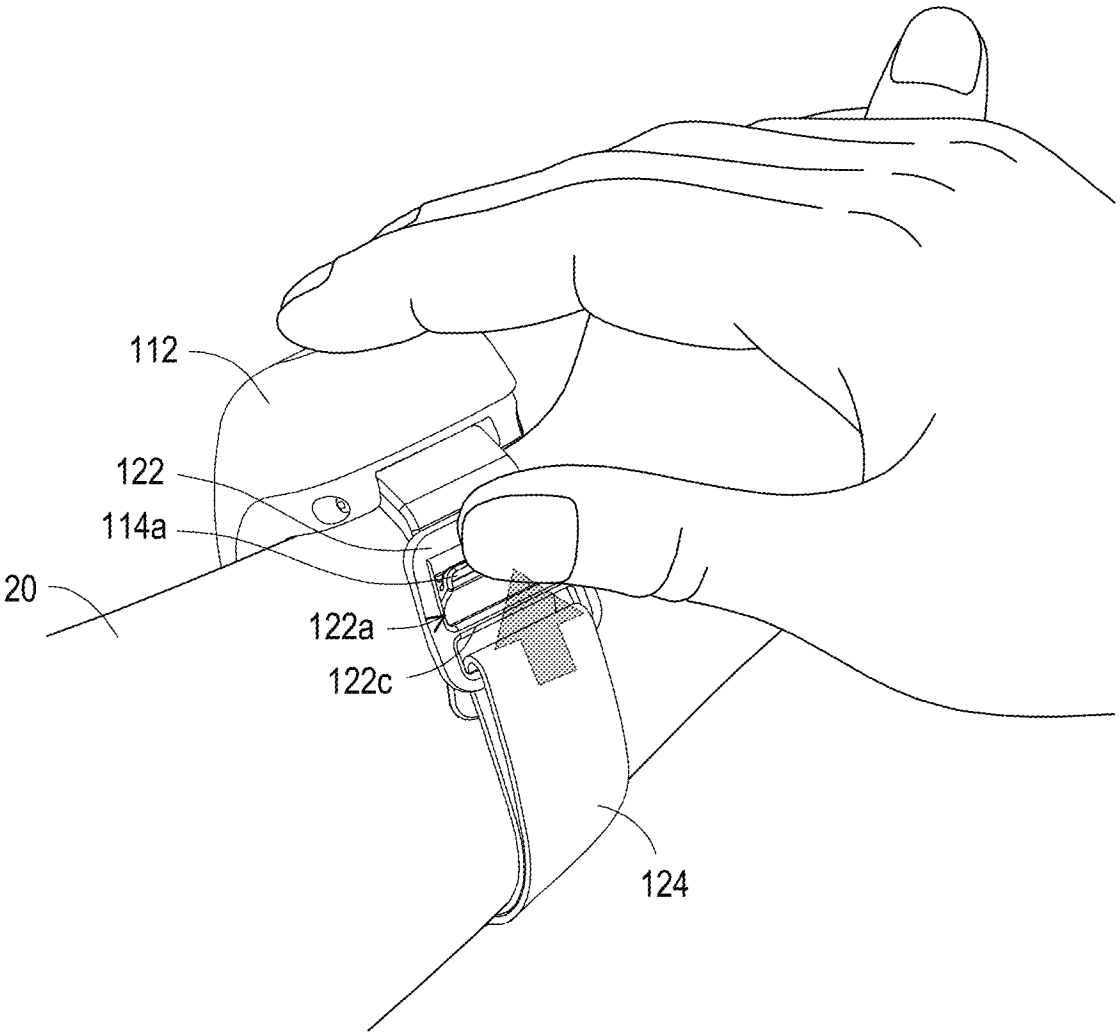
FIG. 3A is a schematic view of the insertion of the buckle hole of the wearable device of FIG. 1 into the hook portion.

FIG. 1 is a schematic view of a wearable device according to an embodiment of the invention. FIG. 2 is a schematic side view of the wearable device of FIG. 1. FIG. 3A is a schematic view of the insertion of the buckle hole of the wearable device of FIG. 1 into the hook portion. Please refer to FIG. 1, FIG. 2, and FIG. 3A, a wearable device 100 of the present embodiment includes a main body 110 and a coupling member 120. The main body 110 has a tail portion 112*a* and a hook portion 114*a* at two opposite sides respectively. One end of the coupling member 120 is connected to the tail portion 112*a* of the main body 110, and a buckle hole 122*a* at another end of the coupling member 120 is used to be sleeved on the hook portion 114*a* of the main body 110 to fix the main body 110 on a subject 20. It should be noted that although the subject 20 of FIG. 3A is shown as a human wrist, the subject 20 may be a human body portion such as a human torso, an arm, or a head, or other objects. The present application does not limit the type of the subject 20.

When the user wears the wearable device 100 of the present embodiment, it is only necessary to push the coupling member 120 with the thumb of one hand so that the buckle hole 122*a* thereof continues to slide along the hook portion 114*a* of the main body 110 until the buckle hole 122*a* passes over the hook portion 114*a* and is sleeved on the hook portion 114*a*. Meanwhile, the wearable device 100 may be fixed to the subject 20 by fixing the main body 110 with other fingers of the same hand to prevent the main body 110 from sliding. Likewise, after the buckle hole 122*a* is released from the hook portion 114*a*, the wearable device 100 may be removed from the subject 20. Compared with the conventional wearable device, the wearing and removal method of the wearable device 100 of the present embodiment is simple, and the operation may be completed with only one hand, and the wearable device 100 may be temporarily and steadily fixed on the subject 20 without additional assistance. Moreover, the operation process takes less time and the wearable device 100 may be quickly worn and removed, and the operation process may be completed quickly even with a non-dominant hand, and it is convenient to switch users quickly. In other words, the user may quickly wear the wearable device 100 to the left hand or the right hand.

Moreover, in the wearable device 100 of the present embodiment, the main body 110 is directly placed on the subject 20 to be fixed, and then the buckle hole 122*a* of the coupling member 120 is sleeved on the hook portion 114*a* of the main body 110 to fix the main body 110 on the subject 20. In other words, the main body 110 does not need to pass through the palm of the user in a state where two ends of the coupling member 120 are combined with the body 110. That is, the length of the coupling member 120 does not need to be dependent on the individual circumferential dimension of the user's palm, and the length of the coupling member 120 only needs to depend on the individual circumferential dimension of the user's wrist. In this way, by calculating the length of the coupling member 120 by analyzing the individual dimension data of the circumference of the wrist, the length of the coupling member 120 may be significantly shortened, and the trouble of the user handling excess strap may also be alleviated, so that the appearance after wearing is complete is simpler and more appealing.

In the present embodiment, the main body 110 includes, for example, a device member 112, and the device member 112 has the tail portion 112*a*. The device member 112 is, for example, a watch body, a wireless positioning device, a virtual reality device, or a healthcare device. The present application does not limit the type of the device member 112. In addition, as shown in FIG. 2, the appearance of the device member 112 of the present embodiment is substantially L-shaped. When the user fixes the wearable device 100 on a subject 20 having corners or discontinuous arcs, the L-shaped device 112 may bear against different planes of the subject 20 at the same time. Accordingly, during the process of fixing the wearable device 100 of the present embodiment to the subject 20, even if the wearable device 100 is shaken a little, the L-shaped device 112 may steadily bear against the subject 20 and not readily slide. In other embodiments, the appearance of the device member 112 may also be in the shape of, for example, an arc or a plane. The present application does not limit the appearance shape of the device member 112.

Referring to FIG. 1 and FIG. 2, the main body 110 of the present embodiment further includes, for example, a clamping member 114 pivotally connected to the device member 112, and the clamping member 114 has the hook portion 114*a*. Since the clamping member 114 may be pivoted relative to the device member 112, the angle between the clamping member 114 and the device member 112 may be adjusted to be similar to the shape of the subject 20, in order to provide steady strength during the fixing process of the wearable device 100. Therefore, there is no need to worry about pulling the main body 110 off when the coupling member 120 is pulled, so the main body 110 does not particularly need to be leant against other objects (such as a desktop or other portions of the body) to maintain stability. Moreover, the hook portion 114*a* is disposed on the clamping member 114, so the position of the hook member 114*a* is also changed with the rotation of the clamping member 114, so that the wearable device 100 of the present embodiment is suitable for fixing subjects 20 of different sizes.

In addition, the main body 110 of the present embodiment further includes, for example, a torsion spring 116 (shown in FIG. 2) disposed at the pivotal connection of the clamping member 114 and the device member 112. When the device member 112 is borne against the subject 20, the torsion spring 116 provides elastic force to rotate the clamping member 114 in the direction of the device member 112. Therefore, the subject 20 is clamped between the clamping member 114 and the device member 112, so that the wearable device 100 is not readily slipped off from the subject 20. When operation may only be performed with one hand, the user may wear or remove with peace of mind, and does not need to worry about the wearable device 100 falling off and being damaged.

Figure 3C:
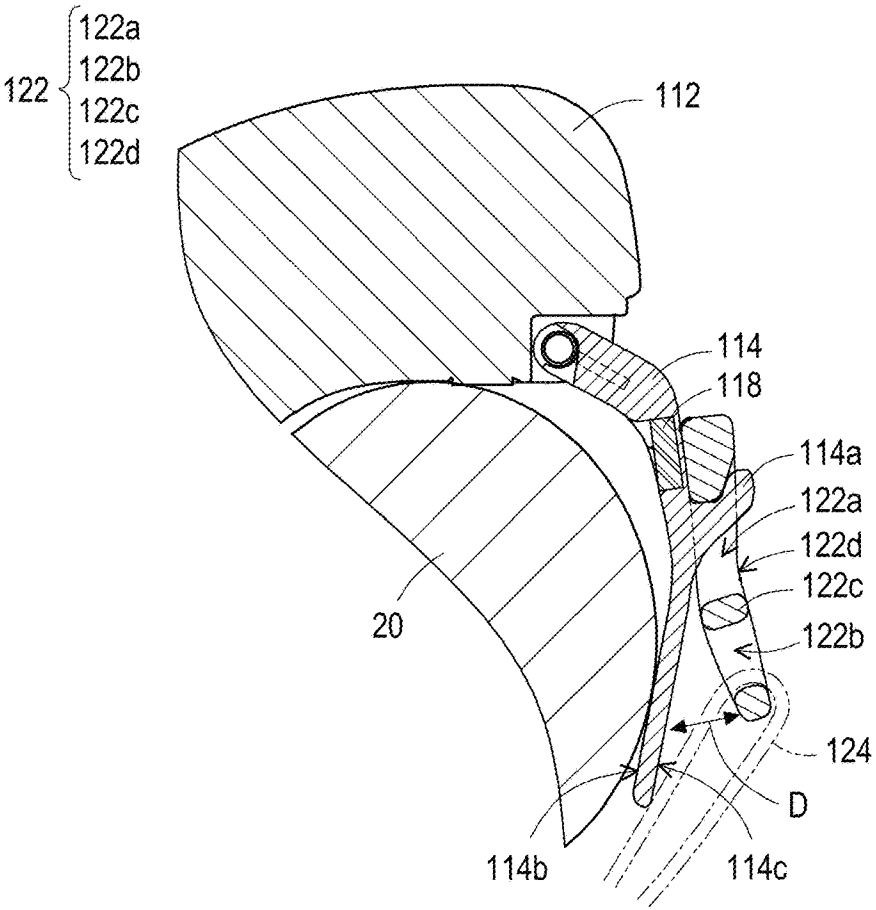
FIG. 3B and FIG. 3C are partial cross-sectional schematic views of the buckle hole of FIG. 3A before and after being inserted into the hook portion, respectively.
Figure 3B:
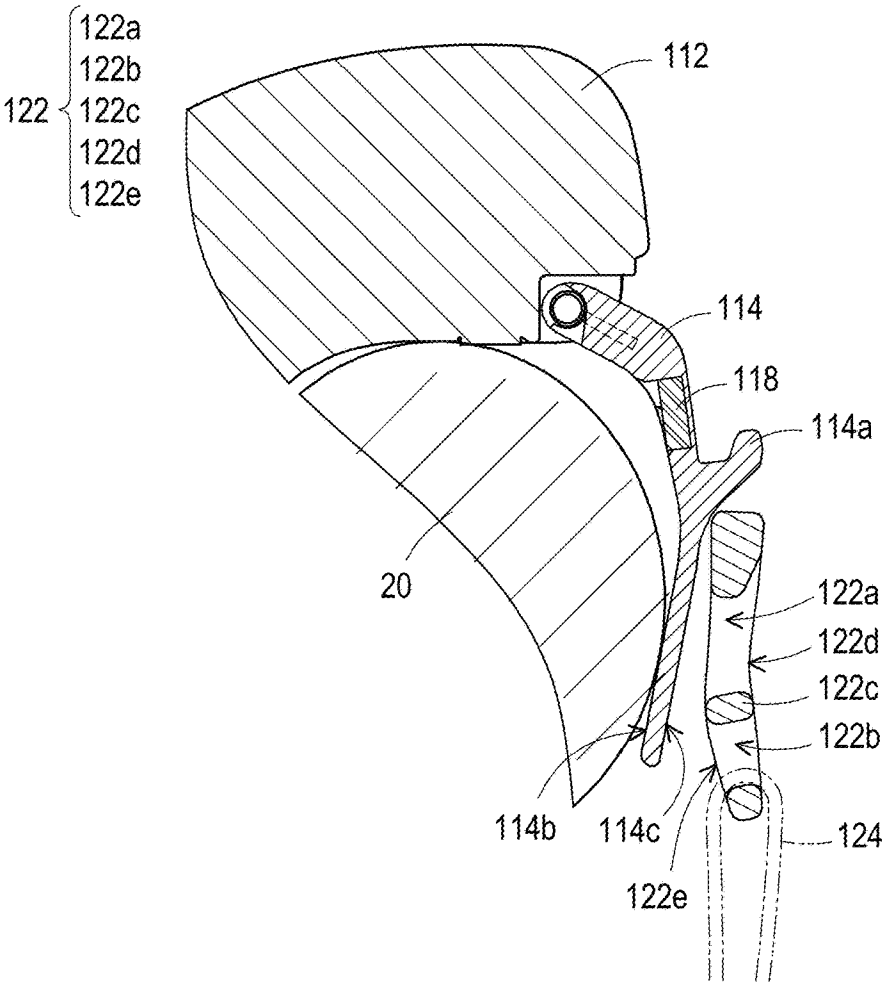

FIG. 3B and FIG. 3C are partial cross-sectional schematic views of the buckle hole of FIG. 3A before and after being inserted into the hook portion, respectively. It should be noted that, in order to make the drawings concise and the reference numerals clearly visible, belt bodies 124 of FIG. 3B and FIG. 3C are all represented by dotted lines.

Please refer to FIG. 3B and FIG. 3C, the clamping member 114 of the present embodiment is in a curved shape. When the main body 110 is fixed to the subject 20, a concave side 114*b* of the clamping member 114 faces the subject 20. In the present embodiment, a convex side 114*c* of the clamping member 114 has the hook portion 114*a*. Since the clamping member 114 is in a curved shape, when the wearable device 100 is fixed to the subject 20, the clamping member 114 may better fit the subject 20 and be steadily fixed on the subject 20. Meanwhile, the hook portion 114*a* and the subject 20 are located on two opposite sides of the clamping member 114, so the buckle hole 122*a* may be smoothly sleeved on the hook portion 114*a* without pinching, pressing, or interfering with the subject 20.

Please refer to FIG. 1, FIG. 3B, and FIG. 3C. In the present embodiment, the coupling member 120 includes, for example, a buckle 122 and a belt body 124. The buckle 122 has the buckle hole 122*a* and a belt hole 122*b*. One end of the belt body 124 is connected to the tail portion 112*a*, and another end of the belt body 124 is fixed to a portion of the belt body 124 through the belt hole 122*b*, so that the belt body 124 is connected to the buckle 122. In the present embodiment, another end of the belt body 124 is adhered by a devil felt, magnetically attracted, or snapped onto a portion of the belt body 124, but the present application is not limited thereto.

When a user wears a conventional wearable device, the conventional wearable device may be steadily fixed simply by completing actions such as passing the belt body through the fixing ring and adjusting and fixing the length of the belt body all at once. Compared with the prior art, when the user fixes the wearable device 100 of the present embodiment to the subject 20, the buckle hole 122*a* may be sleeved on the hook portion 114*a* to complete the preliminary fixation, and then the length of the belt body 124 may be adjusted to further steadily fix the wearable device 100 on the subject 20. When fixing the wearable device 100 of the present embodiment, the user may operate in stages without completing the action all at once, thus improving the convenience of the user's operation. In addition, the user may readily adjust the length of the belt body 124 for fixing on subjects 20 of different sizes. Moreover, the buckle 122 and the belt body 124 are continuously connected to each other, so there is no need to pass the belt body 124 through the buckle 122 or perform other unnecessary actions, thus avoiding interference or erroneous actions, and the wearable device 100 is also not pushed to deviate from the predetermined ideal position, thus achieving the object of fast wear and removal.

In the present embodiment, the buckle 122 is in a curved shape. When the main body 110 is fixed to the subject 20, a concave side 122*d* of the buckle 122 faces away from the subject 20, and the side of the buckle 122 connected to the belt body 124 maintains a distance D from the clamping member 114. In other words, the orientation of the concave side 122*d* of the buckle 122 is opposite to the orientation of the concave side 114*b* of the clamping member 114.

Referring to FIG. 3A to FIG. 3C, when the user inserts the buckle 122 into the hook portion 114*a*, as shown in FIG. 3A, the user may press the device member 112 with the index finger to prevent the device member 112 from sliding, and push the buckle 122 in a curved shape with the thumb to slide. As shown in FIG. 3B and FIG. 3C, the user only needs to lean a convex side 122*e* of the buckle 122 against the hook portion 114*a* and slide the convex side 122*e* of the buckle 122 along the hook portion 114*a*, so that after the buckle hole 122*a* is moved to the free end of the hook portion 114*a*, the buckle hole 122*a* may consequently be inserted into the hook portion 114*a*. Since the buckle hole 122*a* may be aligned with the hook portion 114*a* and inserted simply by performing the above intuitive action, the issue of erroneous operation or interference that causes the wearable device 100 to deviate from the predetermined fixed position or not be fixed to the subject 20 does not occur.

In addition, please continue to refer to FIG. 3B and FIG. 3C, a magnetic attraction member 118 may be disposed on the inner side of the clamping member 114. The material of the buckle 122 may be iron or other materials that may be magnetically attracted. When the buckle hole 122*a* is moved to the free end of the hook portion 114*a*, the buckle 122 is attracted by the magnetic attraction member 118, so that the hook portion 114*a* is automatically buckled into the buckle hole 122*a*. Such a design may help the user to fix the wearable device 100, and may also reduce the probability of the buckle 122 being accidentally separated from the hook portion 114*a*.

Figure 4A:
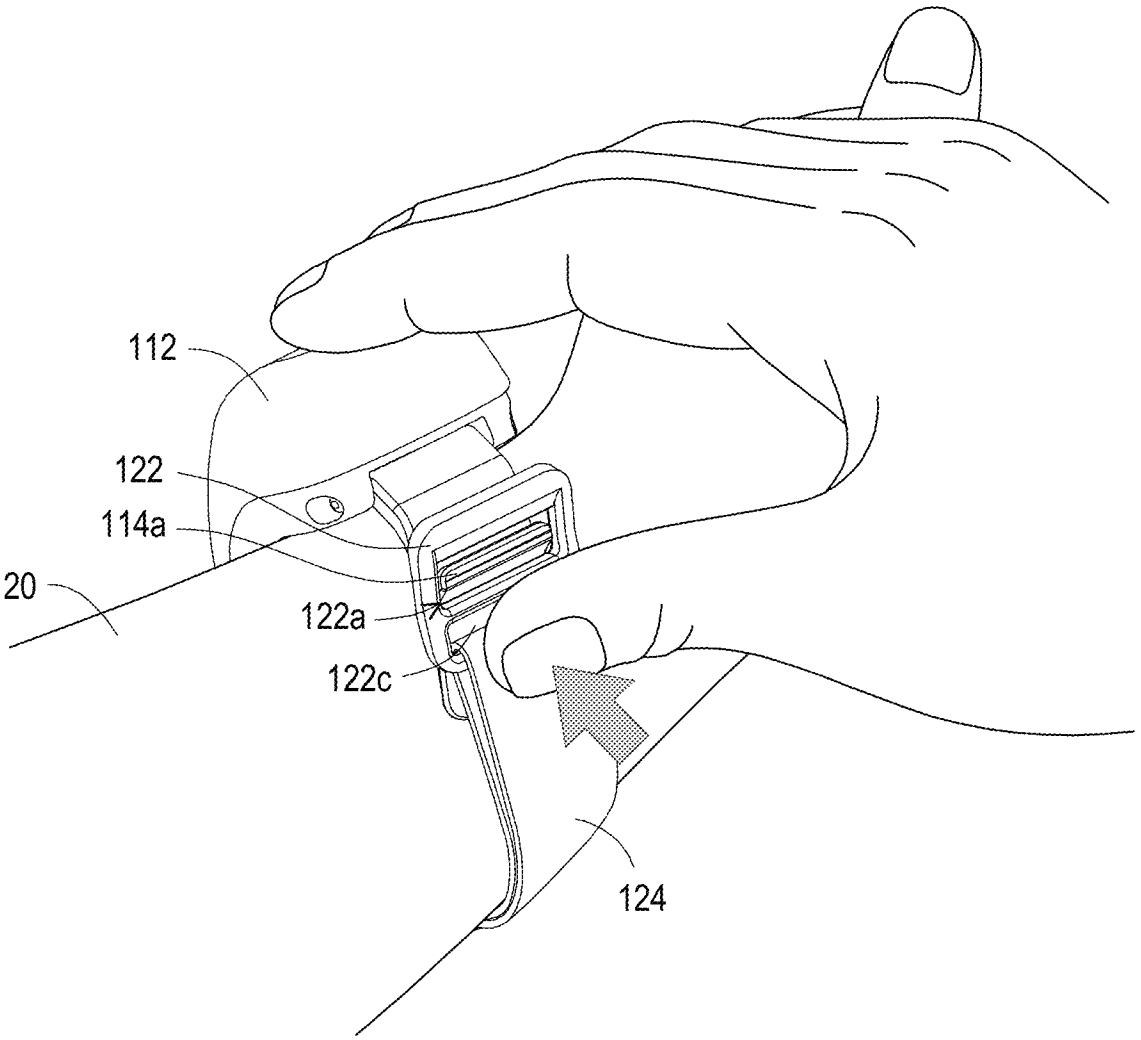
FIG. 4A is a schematic view of the buckle hole of the wearable device of FIG. 1 being separated from the hook portion.
Figure 4B:
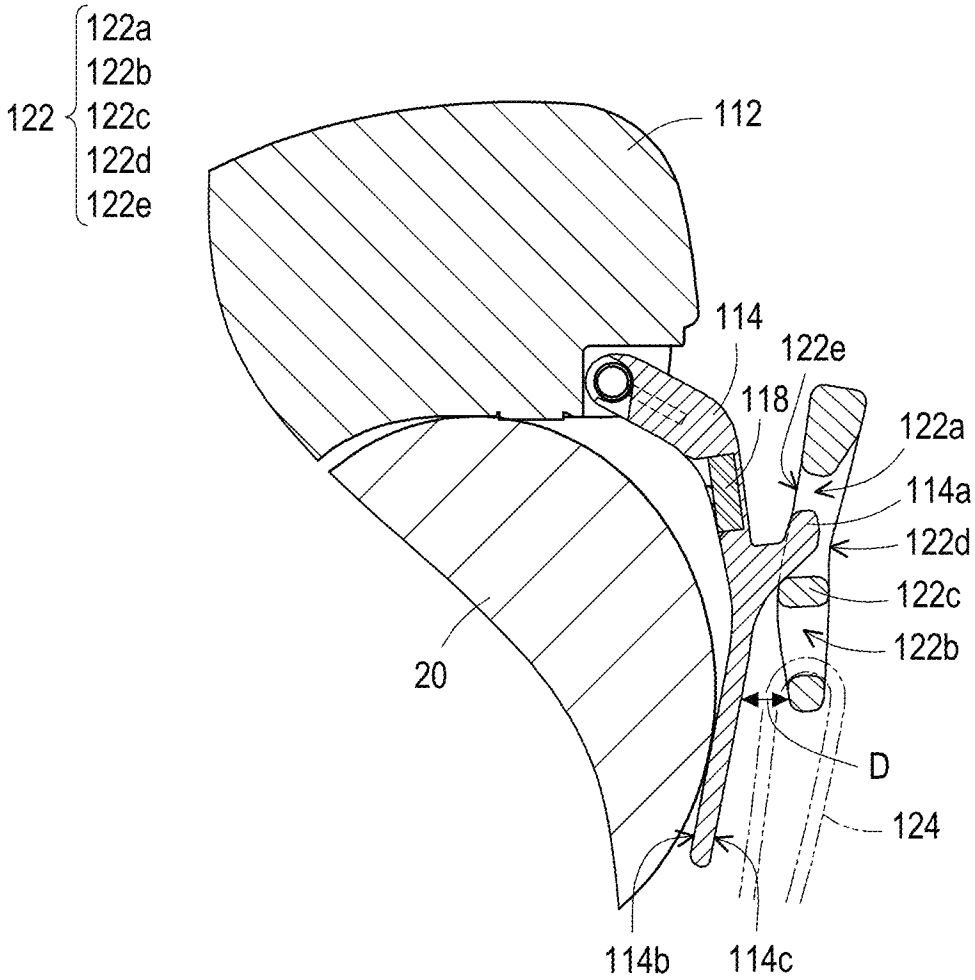
FIG. 4B is a partial cross-sectional schematic view of the buckle hole of FIG. 4A after being separated from the hook portion.

FIG. 4A is a schematic view of the buckle hole of the wearable device of FIG. 1 being separated from the hook portion. FIG. 4B is a partial cross-sectional schematic view of the buckle hole of FIG. 4A after being separated from the hook portion. It should be noted that, in order to make the drawing concise and the reference numerals clearly visible, the belt body 124 of FIG. 4B is represented by a dotted line. Please refer to FIG. 3C, FIG. 4A, and FIG. 4B simultaneously. In the present embodiment, the buckle 122 further has a sliding rod 122*c*, and the sliding rod 122*c* is located between the buckle hole 122*a* and the belt hole 122*b*.

Similarly, when the user wants to separate the buckle hole 122*a* from the hook portion 114*a*, as shown in FIG. 4A, the user may press the device member 112 with the index finger to prevent the device member 112 from sliding, and use the thumb to separate the buckle hole 122*a* from the hook portion 114*a*. As shown in FIG. 3C and FIG. 4B, since the convex side 122*e* of the buckle 122 and the convex side 114*c* of the clamping member 114 are abutted against each other, the side of the buckle 122 connected to the belt body 124 is upturned relative to the clamping member 114 to maintain the distance D. The user may press the upturned side of the buckle 122 connected to the belt body 124 to the subject 20, so that the other side of the buckle 122 (that is, the side where the buckle 122 is inserted into the hook portion 114*a*) is moved in a direction away from the subject 20.

In the present embodiment, the hook portion 114*a* is inclined toward the pivotal connection of the clamping member 114 and the device member 112. The user presses the upturned buckle 122 and then pushes the buckle 122, so that the sliding rod 122*c* leant against the hook portion 114*a* is moved toward the pivotal connection of the clamping member 114 and the device member 112. When the sliding rod 122*c* is moved to the free end of the hook portion 114*a*, the buckle hole 122*a* sleeved on the hook portion 114*a* may be separated from the hook portion 114*a*.

Since the user may stably separate the buckle hole 122*a* from the hook portion 114*a* with only one hand, the operation is much simpler, and the wearable device 100 of the present embodiment may also be quickly removed from the subject 20, instead of being hooked back due to the pulling force of the belt body 124, thus achieving the object of fast wear and removal.

Figure 5A:
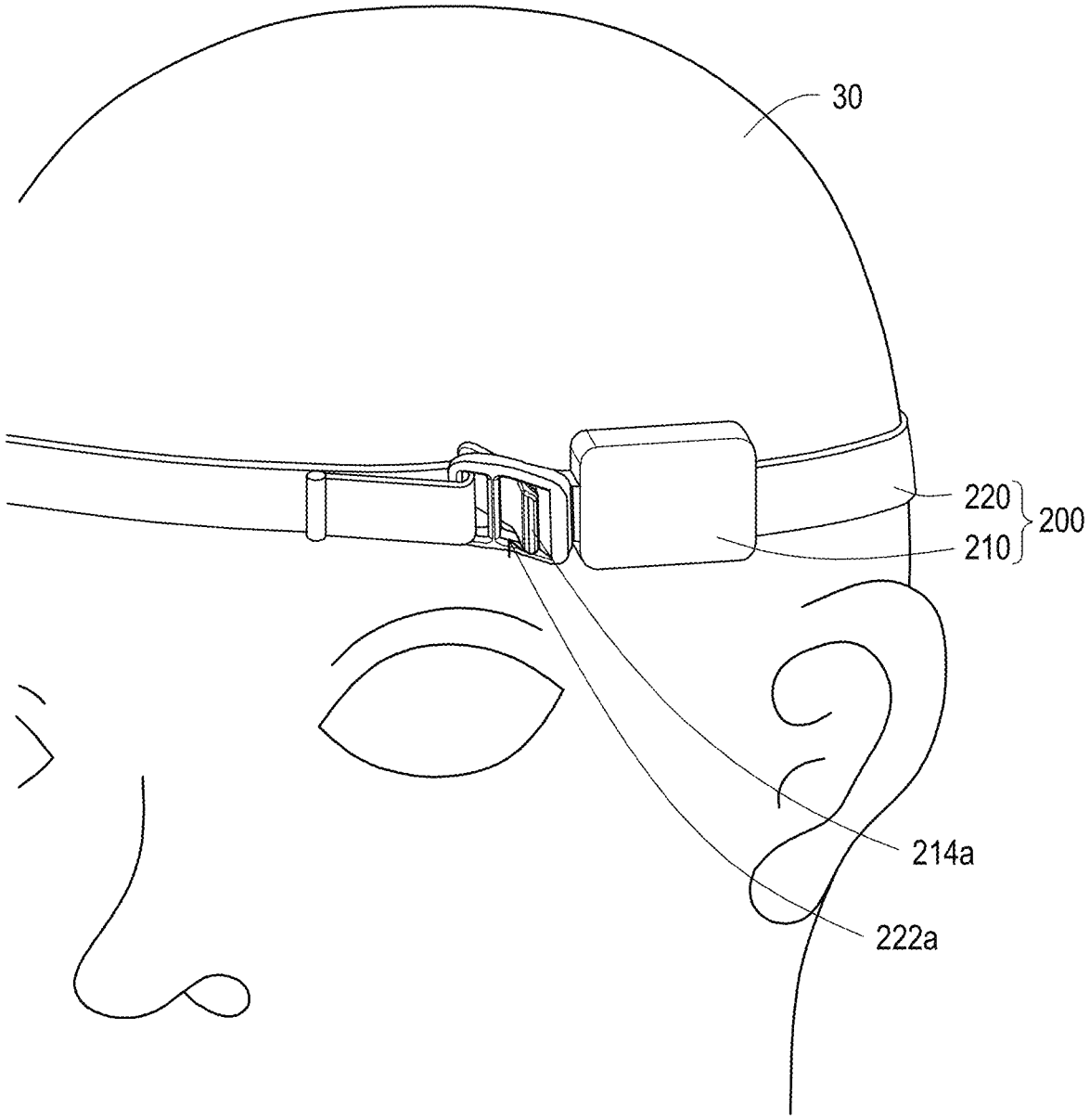
FIG. 5A and FIG. 5B are schematic views of different portions of a user wearing a wearable device of other embodiments of the invention, respectively.
Figure 5B:
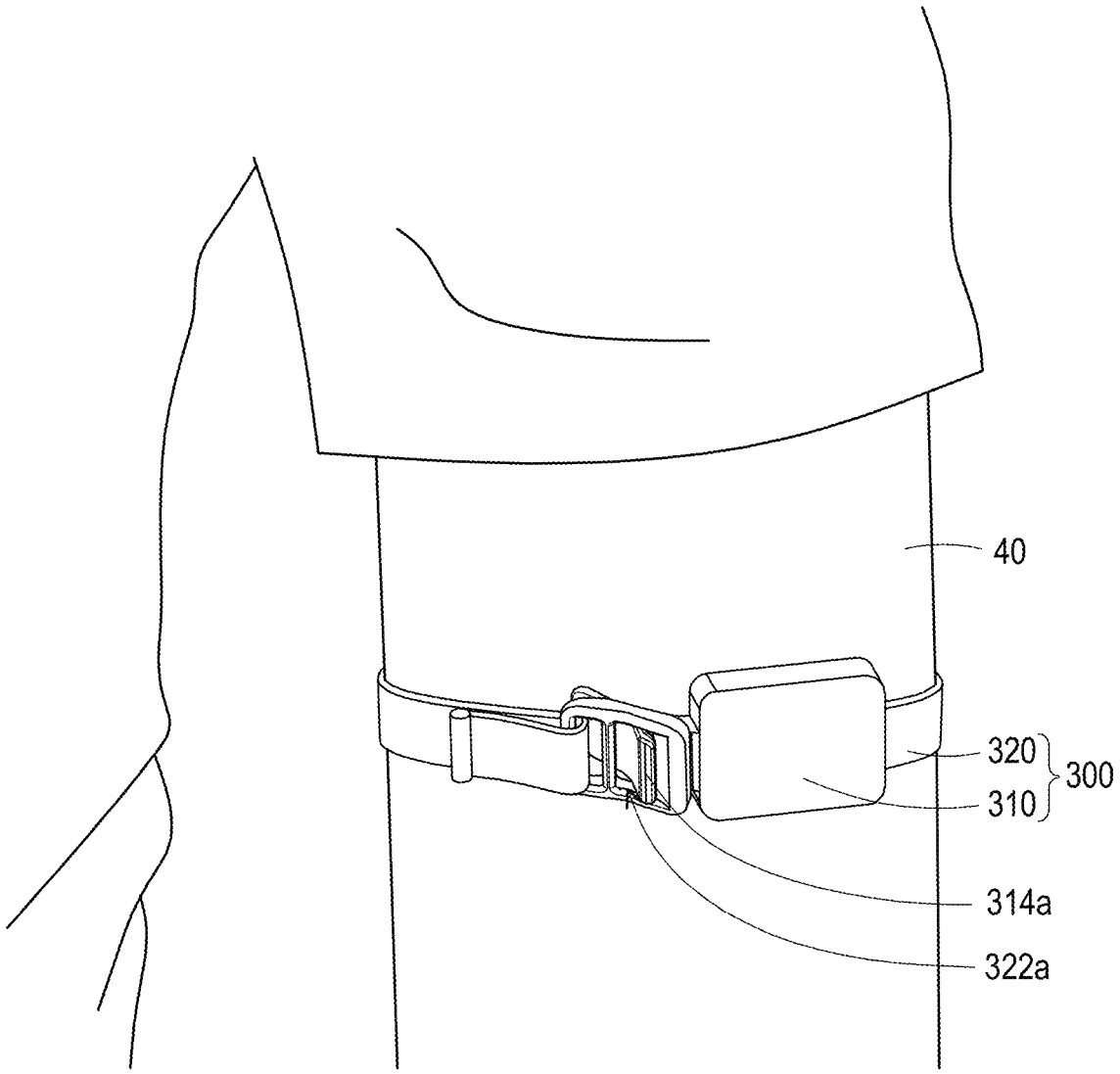

FIG. 5A and FIG. 5B are schematic views of different portions of a user wearing a wearable device of other embodiments of the invention, respectively. Referring to FIG. 5A, a wearable device 200 of the embodiment is similar to the wearable device 100 of FIG. 1, and the difference is that the wearable device 200 of the present embodiment is worn on a subject 30, and the subject 30 is the user's head. The wearable device 200 further includes a main body 210 and a coupling member 220, and a buckle hole 222*a* of the coupling member 220 may be sleeved on a hook portion 214*a* of the main body 210 to fix the main body 210 on the subject 30.

Referring further to FIG. 5B, a wearable device 300 of the embodiment is similar to the wearable device 100 of FIG. 1, and the difference is that the wearable device 300 of the present embodiment is worn on a subject 40, and the subject 40 is the user's arm. The wearable device 300 further includes a main body 310 and a coupling member 320, and a buckle hole 322*a* of the coupling member 320 may be sleeved on a hook portion 314*a* of the main body 310 to fix the main body 310 on the subject 40.

Based on the above, in the wearable device of the present application, the user may wear and remove the wearable device simply by inserting or separating the buckle hole from the hook portion with the thumb of one hand. The method of operating the wearable device is simple, the time needed for wearing and removing the wearable device is reduced, and the trouble of the user in dealing with excess strap is also reduced, and the wearable device of the present application may be quickly worn or removed. In addition, the length of the belt body may be readily adjusted to fix subjects of different sizes. When the clamping member and the torsion spring are optionally arranged, the main body may be fixed to the subject and not be readily slipped and damaged, and there is no need to lean on other objects to keep the main body steady. Moreover, when the design in which the clamping member is bent toward the subject and the buckle is bent away from the subject is adopted, it is easier for the user to insert or separate the buckle from the hook portion, thereby improving the convenience of use. Via the above design, the wearable device of the present application helps to improve the overall user's operating experience.

What is claimed is:

1. A wearable device, comprising:

a main body having a tail portion and a hook portion at two opposite sides respectively, wherein the main body comprises a device member, a clamping member, and a torsion spring, the clamping member is pivotally connected to the device member, the device member has the tail portion, the clamping member has the hook portion, and the torsion spring is disposed at a pivotal connection of the clamping member and the device member; and a coupling member, wherein one end of the coupling member is connected to the tail portion, and a buckle hole of another end of the coupling member is for sleeving onto the hook portion to fix the main body to a subject.

2. The wearable device of claim 1, wherein the clamping member is in a curved shape, and when the main body is fixed to the subject, a concave side of the clamping member faces the subject.

3. The wearable device of claim 2, wherein the hook portion is provided on a convex side of the clamping member.

4. The wearable device of claim 1, wherein the coupling member comprises:

a buckle having the buckle hole and a belt hole; and a belt body, wherein one end of the belt body is connected to the tail portion, and another end of the belt body is fixed on a portion of the belt body through the belt hole, so that the belt body is connected with the buckle.

5. The wearable device of claim 4, wherein the buckle is in a curved shape, and when the main body is fixed to the subject, a concave side of the buckle faces away from the subject, and a side of the buckle connected to the belt body maintains a distance from the clamping member.

6. The wearable device of claim 4, wherein the buckle further has a sliding rod, the sliding rod is located between the buckle hole and the belt hole, the hook portion is inclined toward a pivotal connection of the clamping member and the device member, and when the sliding rod is leant against the hook portion and moved to a free end of the hook portion, the buckle hole sleeved on the hook portion is separated from the hook portion.

7. The wearable device of claim 4, wherein another end of the belt body is adhered by a hook-and-loop fastener, magnetically attracted, or snapped onto the portion of the belt body.

* * * * *